US010222041B2

(12) United States Patent
Lin

(10) Patent No.: US 10,222,041 B2
(45) Date of Patent: Mar. 5, 2019

(54) STRIP LIGHT SWITCH

(71) Applicant: DIPTRONICS MANUFACTURING INC., New Taipei (TW)

(72) Inventor: Shi-Chi Lin, New Taipei (TW)

(73) Assignee: DIPTRONICS MANUFACTURING INC., New Taipei (TW)

( * ) Notice: Subject to any disclaimer, the term of this patent is extended or adjusted under 35 U.S.C. 154(b) by 0 days.

(21) Appl. No.: 15/814,938

(22) Filed: Nov. 16, 2017

(65) Prior Publication Data

US 2018/0283669 A1 Oct. 4, 2018

(30) Foreign Application Priority Data

Mar. 29, 2017 (TW) ..... 106204412 U

(51) Int. Cl.

| | |
|---|---|
| ***H01H 13/02*** | (2006.01) |
| ***F21V 23/04*** | (2006.01) |
| ***F21V 21/005*** | (2006.01) |
| ***H01H 13/14*** | (2006.01) |
| *H01H 13/52* | (2006.01) |

(52) U.S. Cl.

CPC ..... *F21V 23/04* (2013.01); *F21V 21/005* (2013.01); *H01H 13/023* (2013.01); *H01H 13/14* (2013.01); *H01H 2013/525* (2013.01); *H01H 2203/038* (2013.01); *H01H 2227/026* (2013.01)

(58) Field of Classification Search

CPC ..... H01H 13/023; H01H 2203/038; H01H 2215/004; H01H 2215/012; H01H 2215/018; H01H 2227/022; H01H 2227/026; F21V 23/04

See application file for complete search history.

(56) References Cited

U.S. PATENT DOCUMENTS 4,161,637 A * 7/1979 Priesemuth ..... H01H 13/562 200/314
4,385,219 A * 5/1983 Finlayson ..... H01H 15/102 200/241
4,549,050 A * 10/1985 Lang ..... H01H 9/182 200/310
5,150,257 A * 9/1992 Mohabbatizadeh .... F21V 11/00 340/815.55

(Continued)

*Primary Examiner* — Felix O Figueroa

(74) *Attorney, Agent, or Firm* — Muncy, Geissler, Olds & Lowe, P.C.

(57) ABSTRACT

A strip light switch includes an insulative housing with terminal grooves and positioning grooves defined in an accommodation chamber therein, a terminal set including at least one first terminal, at least one second terminal and multiple third terminals mounted in the terminal grooves and multiple mating connection terminals detachably mounted in the positioning grooves in a replaceable manner for conduction with the third terminals, a conductive shrapnel mounted in the accommodation chamber, and a press device including a cylindrical press block supported on the conductive shrapnel pressable by a user to force the conductive shrapnel in conducting the first and second terminals, conducting plates mounted in the cylindrical press block and disposed in contact with the conducting plates of the mating connection terminal and a light-emitting component mounted in the cylindrical press block for electrical contact with the conducting plates.

10 Claims, 7 Drawing Sheets

(56) References Cited

U.S. PATENT DOCUMENTS

| | | | | |
|---|---|---|---|---|
| 6,310,308 | B1 * | 10/2001 | Watson | H01H 13/023 200/314 |
| 7,202,429 | B2 * | 4/2007 | Bouvier | H01H 13/023 200/310 |
| 7,220,931 | B2 * | 5/2007 | Bouvier | H01H 13/023 200/314 |
| 7,667,152 | B2 * | 2/2010 | Su | H01H 13/023 200/313 |
| 7,800,006 | B2 * | 9/2010 | Mishima | H01H 13/023 200/341 |

* cited by examiner

STRIP LIGHT SWITCH

BACKGROUND OF THE INVENTION

This application claims the priority benefit of Taiwan patent application number 106204412, filed on Mar. 29, 2017.

1. Field of the Invention

The present invention relates to switch technology and more particularly, to a strip light switch, which has the mating connection terminals of the terminal set thereof respectively detachably mounted in respective positioning grooves in the insulative housing thereof, so that the mating connection terminals can be removed from the positioning grooves for a replacement if they are permanently deformed or get broken, facilitating maintenance and repair works, improving maintenance speed, and saving material and maintenance costs.

2. Description of the Related Art

FIGS. 6 and 7 illustrate a strip light switch according to the prior art. According to this design, the strip light switch comprises a housing A, a terminal set B, a conductive shrapnel C, a press device D and a light-emitting component E. The housing A defines therein an accommodation chamber A1. The terminal set B is mounted in the accommodation chamber A1 using insert molding technology, comprising two mating connection members B1 vertically disposed in the accommodation chamber A1 at two opposite sides. The conductive shrapnel C is mounted in the accommodation chamber A1 above the terminal set B for conducting the terminal set B. The press device D is mounted in the accommodation chamber A1 above the conductive shrapnel C, and pressable to force the conductive shrapnel C into electrical contact with the terminal set B. Further, the press device D defines a recessed receiving chamber D1 in a top side thereof, having a plurality of conducting plates D2 mounted therein by injection molding. Each conducting plate D2 comprises a <-shaped contact leg D21 extended out of the press device D and disposed in contact with one of the mating connection members B1 of the terminal set B. The light-emitting component E is mounted in the recessed receiving chamber D1, having electrodes E1 for contacting the conducting plates D2 electrically.

When mounting the press device D in the accommodation chamber A1 of the housing A, it is necessary to inwardly curve the contact legs D21 of the conducting plates D2 so that the press device D with the conducting plates D2 can be inserted into the accommodation chamber A1. Of the contact legs D21 are bent with a large force, the contact legs D21 can be permanently deformed or get broken, leading to a contact failure with the terminal set B. When this problem occurs, the product become defective. Further, in application, when the press device D is pressed, the conductive shrapnel C is forced by the press device D into electrical contact with the terminal set B, causing the light-emitting component E to emit light. Because the contact legs D21 of the conducting plates D2 are <-shaped, the contact legs D21 of the conducting plates D2 will be squeezed to deform by the terminal set B when the press device D is pressed, however, if the press device D is frequently pressed or pressed by a large force, the contact legs D21 of the conducting plates D2 can be permanently deformed or get broken, leading to a contact failure with the terminal set B.

Further, because the conducting plates D2 are mounted in the press device D, the whole press device D must be replaced if any of the conducting plates D2 gets broken, complicating the repair work, wasting the component part and increasing the repair costs.

Further, when mounting the terminal set B in the accommodation chamber A1 of the housing A using insert molding technology, running sliders shall be used, thus, burr and fouling can be produced between the accommodation chamber A1 of the housing A and the mating connection members B1 of the terminal set B, thus, a contact failure can occur easily between the mating connection members B1 of the terminal set B and the contact leg D21 of the conducting plates D2 of the press device D, increasing product detect rate.

SUMMARY OF THE INVENTION

The present invention has been accomplished under the circumstances in view. It is therefore the main object of the present invention to provide a strip light switch, which comprises an insulative housing, a terminal set, a conductive shrapnel, and a press device. The insulative housing comprises an accommodation chamber, a plurality of terminal grooves located in a bottom side inside the accommodation chamber, and a plurality of positioning grooves vertically disposed in the accommodation chamber at two opposite sides. The terminal set comprises at least one first terminal, at least one second terminal and a plurality of third terminals respectively positioned in the terminal grooves, and a plurality of mating connection terminals respectively detachably mounted in the positioning grooves and disposed in conduction with the respective third terminals. The conductive shrapnel is accommodated in the accommodation chamber above the terminal set. The press device comprises a cylindrical press block supported on the conductive shrapnel and pressable by the user to force the conductive shrapnel in conducting the first and second terminals, conducting plates mounted in the cylindrical press block and disposed in contact with the conducting plates of the mating connection terminal, and a light-emitting component mounted in the cylindrical press block for electrical contact with the conducting plates. Since the mating connection terminals are respectively detachably mounted in the positioning grooves, they can be removed from the positioning grooves for a replacement if they are permanently deformed or get broken, facilitating maintenance and repair works, improving maintenance speed, and saving material and maintenance costs.

Further, the press device is directly mounted in the accommodation chamber of the insulative housing without needing to bend the contact leg of the conducting plates, avoiding permanent deformation of the contact legs, ensuring positive conduction of the terminal set, facilitating quick installation and improving product yield.

Preferably, each mating connection terminal of the terminal set comprises at least one stop lug inwardly extended from a top side thereof, and an abutment rod inwardly extended from an opposing bottom side thereof. After installation of the mating connection terminals in the respective positioning grooves inside the insulative housing, the stop lugs are respectively stopped at respective recessed stop edges at respective top open ends of the positioning groove, and the abutment rods are respectively disposed in electrical contact with the third contact portions of the third terminals, enhancing signal transmission stability and reliability.

Preferably, the press device further comprises a plurality of protruding blocks located at the bottom side of the cylindrical press block for supporting the contact legs of the conducting plates. When the cylindrical press block of the press device is pressed after its installation in the accommodation chamber of the insulative housing, the contact legs of the conducting plates are stopped by the protruding blocks against deformation, avoiding breaking and prolonging the service life of the conducting plates.

Further, the mating connection terminals of the terminal set are detachably mounted in the respective positioning grooves inside the insulative housing without needing to use any running slider, facilitating mold creation, saving much mold costs. Since no any running slider is used, the invention avoids generation of burr or fouling, maintains good electrical contact, and improves product yield.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
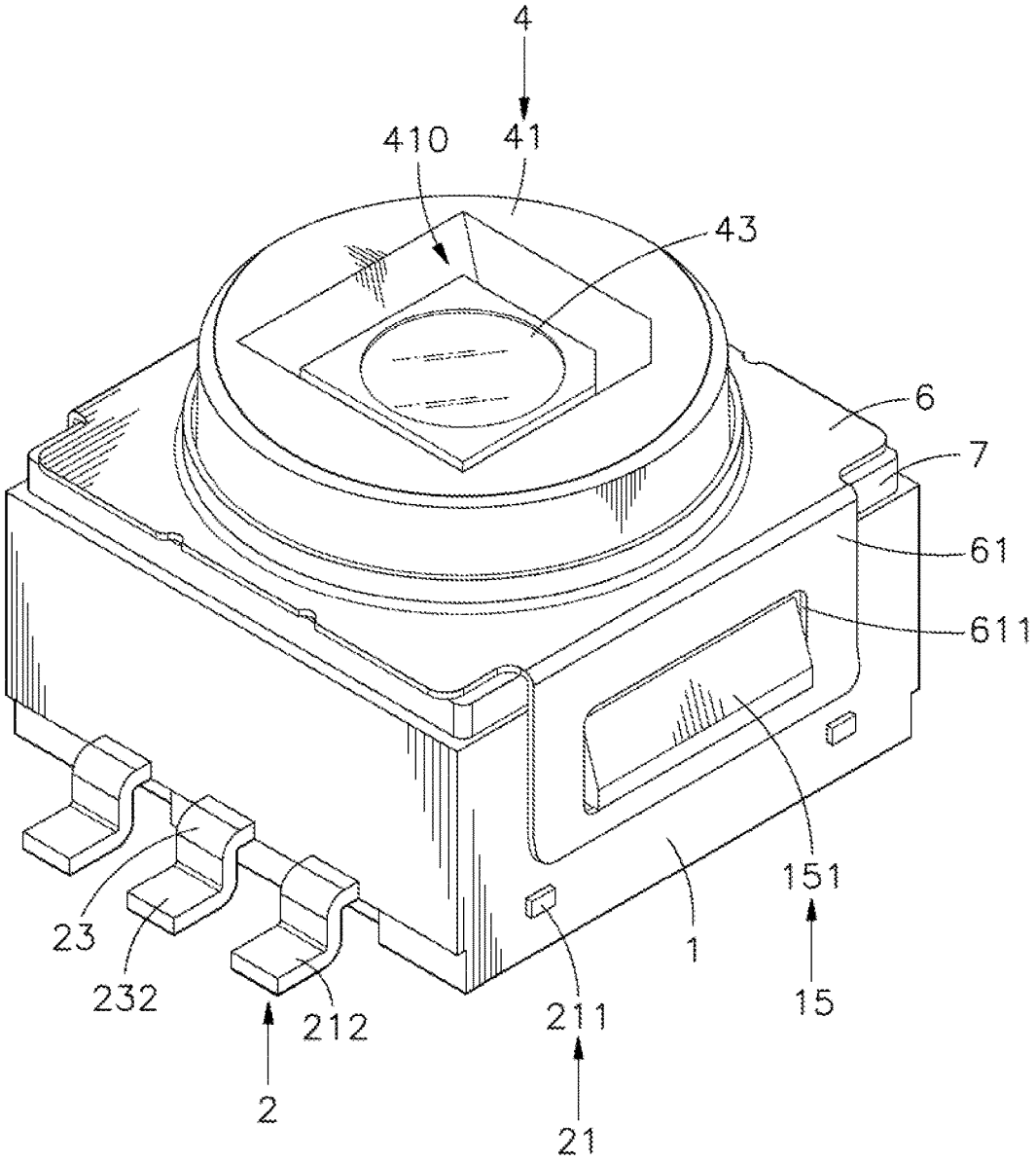
FIG. 1 is an oblique top elevational view of a strip light switch in accordance with the present invention.
Figure 2:
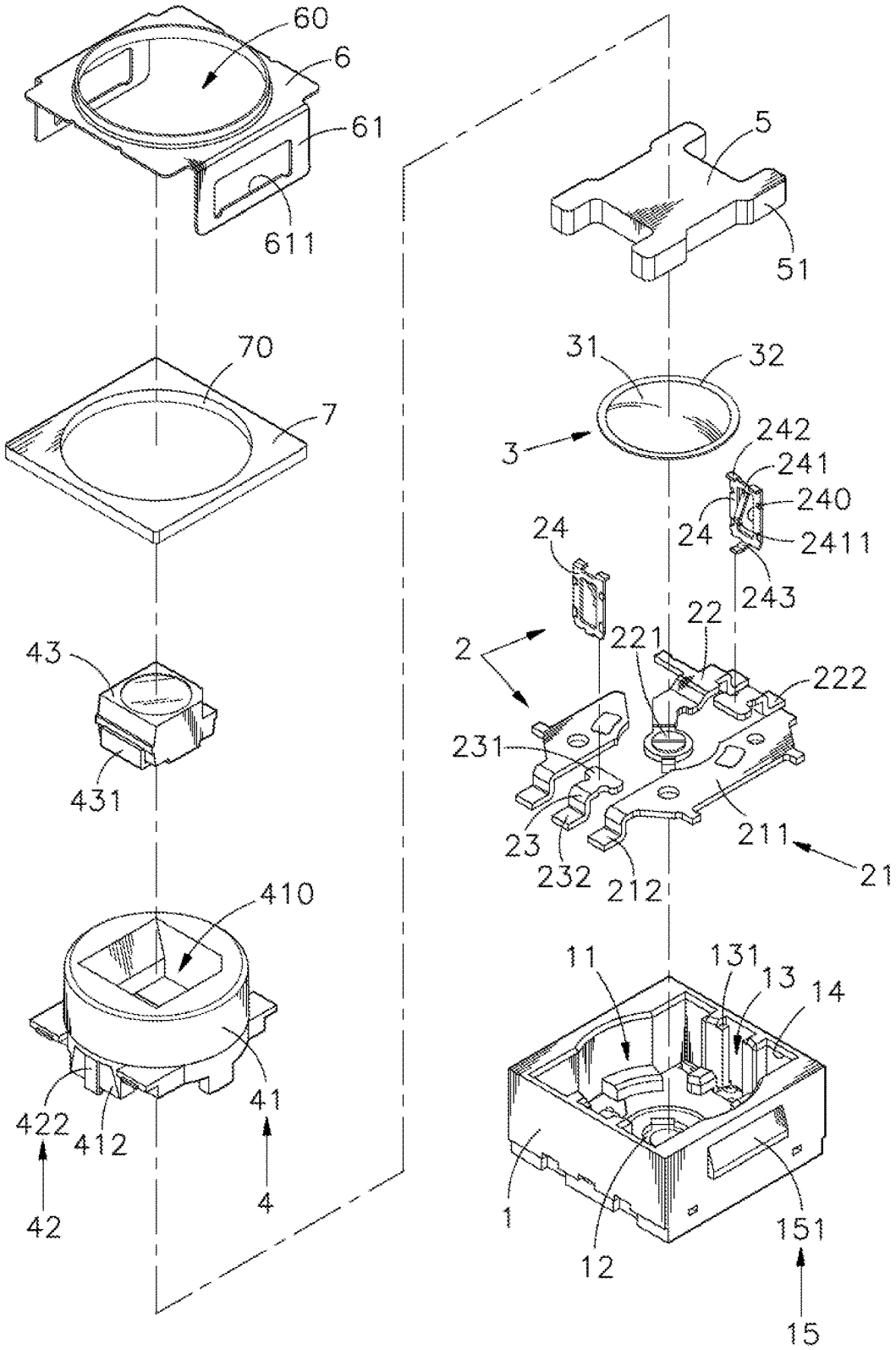
FIG. 2 is an exploded view of the strip light switch in accordance with the present invention.
Figure 3:
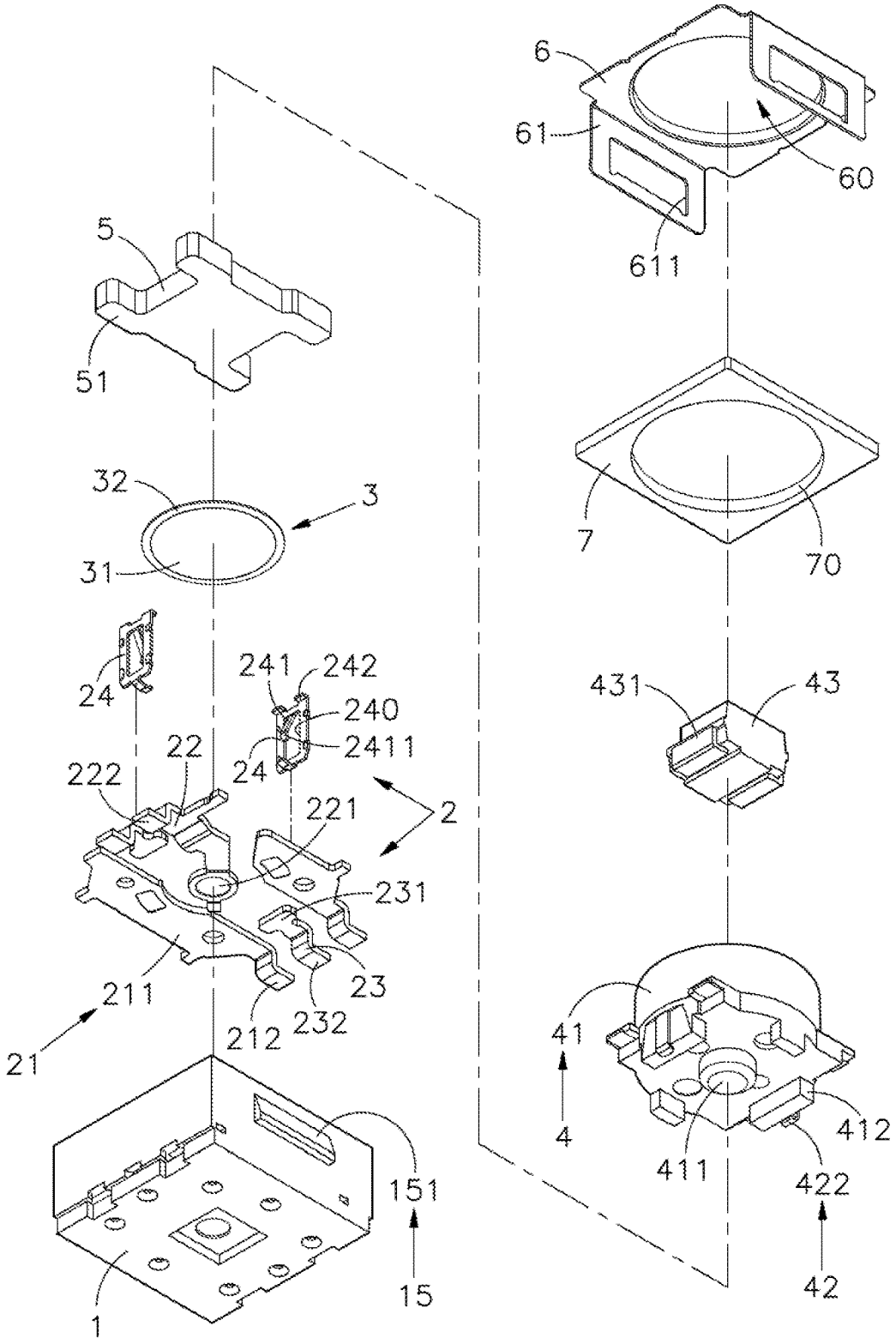
FIG. 3 corresponds to FIG. 2 when viewed from another angle.

Referring to FIGS. 1-3, a strip light switch in accordance with the present invention is shown. The strip light switch comprises an insulative housing 1, a terminal set 2, a conductive shrapnel 3, a press device 4, an elastomer 5, a cover 6 and a gasket 7.

The insulative housing 1 comprises an accommodation chamber 11, a plurality of terminal grooves 12 located in an inner bottom side of the accommodation chamber 11, two positioning grooves 13 vertically disposed in the accommodation chamber 11 at two opposite sides, a recessed stop edge 131 located at a top open end of the each positioning groove 13, at least one position-limiting groove 14 symmetrically disposed at two opposite lateral sides of the each positioning groove 13, and a male retaining structure 15 comprises at least one retaining block 151 symmetrically located at the outer peripheral wall of the insulative housing 1 at two opposite sides.

The terminal set 2 comprises at least one first terminal 21, at least one second terminal 22 and a plurality of third terminals 23 that are kept apart from one another, and a plurality of mating connection terminals 24 respectively electrically connected to the third terminals 23. The first terminal 21 comprises a flat first contact portion 211 located at one side and a curved first bonding portion 212 located at an opposite side. The second terminal 22 comprises a circular second contact portion 221 located at one side, and a second bonding portion 222 located at an opposite side. The third terminals 23 each comprise a third contact portion 231 located at one side and extending toward the second contact portion 221, and a third bonding portion 232 located at an opposite side. The mating connection terminals 24 each comprise a center opening 240, a <-shaped spring arm 241 extended from one side thereof over the center opening 240 and terminating in an abutment tip 2411, at least one stop lug 242 inwardly extended from a top side thereof, and at least one abutment rod 243 inwardly extended from an opposing bottom side thereof.

The conductive shrapnel 3 is shaped like a disc, comprising dome-like pressing portion 31, and an abutment portion 32 extended around an outer perimeter of the dome-like pressing portion 31.

The press device 4 comprises a cylindrical press block 41 made of an electrically insulative material, a plurality of conducting plates 42 and a light-emitting component 43. The cylindrical press block 41 comprises a recessed receiving chamber 410 defined in a top side thereof, a plunger 411 located at an opposing bottom side thereof, and a plurality of protruding blocks 412 extended from the bottom side and spaced around the plunger 411. The conducting plates 42 are mounted in the bottom side of the cylindrical press block 41, each having one end thereof terminating in a contact surface 421 that suspends in the recessed receiving chamber 410 and an opposite end thereof terminating in a contact leg 422 that is disposed outside the cylindrical press block 41 and abutted to the one protruding block 412. The light-emitting component 43 is movably mounted in the recessed receiving chamber 410, comprising a plurality of electrodes 431 disposed at two opposite sides and respectively electrically disposed in contact with the contact surfaces 421 of the conducting plates 42.

The elastomer 5 comprises at least one position-limiting portion 51 extended from two opposite sides thereof.

The cover 6 comprises a center through hole 60, and a female retaining structure 61 comprises at least one retaining hole 611 symmetrically disposed at two opposite lateral sides of the cover 6.

The gasket 7 defines thereof a center hole 70.

In installation, use insert molding technology to respectively mount the at least one first terminal 21, at least one second terminal 22 and multiple third terminals 23 of the terminal set 2 in the terminal grooves 12 of the insulative housing 1, the first contact portion 211 of each first terminal 21, the second contact portion 221 of each second terminal 22 and the third contact portions 231 of the third terminals 23 to suspend in the accommodation chamber 11 inside the insulative housing 1 and the first bonding portion 212 of each first terminal 21, the second bonding portion 222 of each second terminal 22 and the third bonding portions 232 of the third terminals 23 to extend out of the insulative housing 1 for electrical connection to an external circuit board (not shown).

After positioning of the third terminals 23 in the respective terminal grooves 12 in the insulative housing 1, the third contact portions 231 of the third terminal 23 are respectively disposed in respective bottom ends of the positioning grooves 13 in the insulative housing 1. Thereafter, mount the mating connection terminals 24 of the terminal set 2 in the respective positioning grooves 13. At this time, the spring arms 241 of the mating connection terminals 24 suspend in the accommodation chamber 11, the stop lugs 242 of the mating connection terminal 24 are respectively stopped at the recessed stop edges 131 in the top open ends of the positioning groove 13, the abutment rods 243 of the mating connection terminals 24 are respectively disposed in contact with the third contact portions 231 of the respective third terminals 23. Thereafter, mount the conductive shrapnel 3 in the accommodation chamber 11 to force the abutment portion 32 into contact with the first contact portion 211 of each first terminal 21, and then mount the cylindrical press block 41 of the press device 4 in the accommodation chamber 11 inside the insulative housing 1 to stop the plunger 411 against the top surface of the dome-like pressing portion 31 of the conductive shrapnel 3. At this time, the contact legs 422 of the conducting plates 42 are respectively pressed on the abutment tips 2411 of the spring arms 241 to elastically deform the spring arms 241 toward the respective center openings 240. Thereafter, mount the cover 6 and the gasket 7 to the insulative housing 1, allowing the cylindrical press block 41 to be received in the center hole 70 of the gasket 7 and the center through hole 60 of the cover 6. Thereafter, fasten the retaining holes 611 of the female retaining structure 61 to the respective retaining blocks 151 of the male retaining structure 15 of the insulative housing 1.

In the present preferred embodiment, the at least one first terminal 21, at least one second terminal 22 and multiple third terminals 23 of the terminal set 2 are mounted in the insulative housing 1 using insert molding technology. However, this mounting method is not a limitation. Other conventional terminal mounting methods can be selectively used to mount the at least one first terminal 21, at least one second terminal 22 and multiple third terminals 23 of the terminal set 2 in the insulative housing 1.

Figure 4:
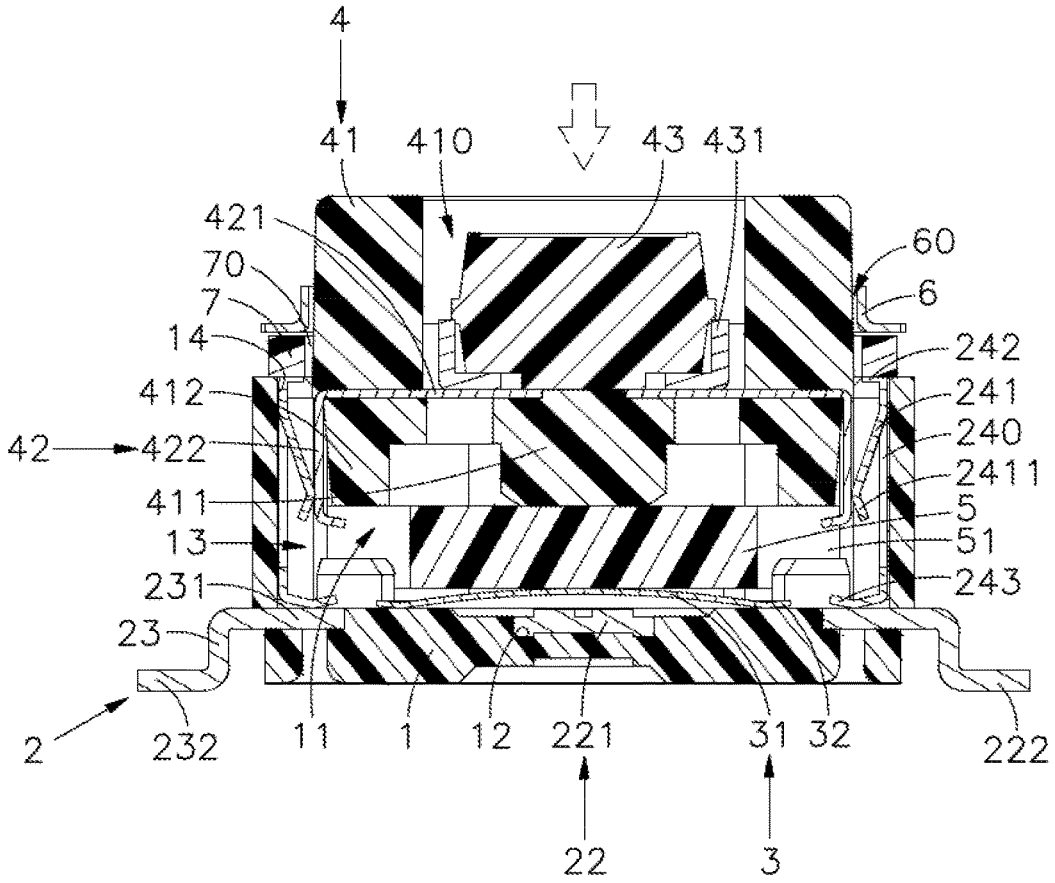
FIG. 4 is a sectional side view of the strip light switch in accordance with the present invention.
Figure 5:
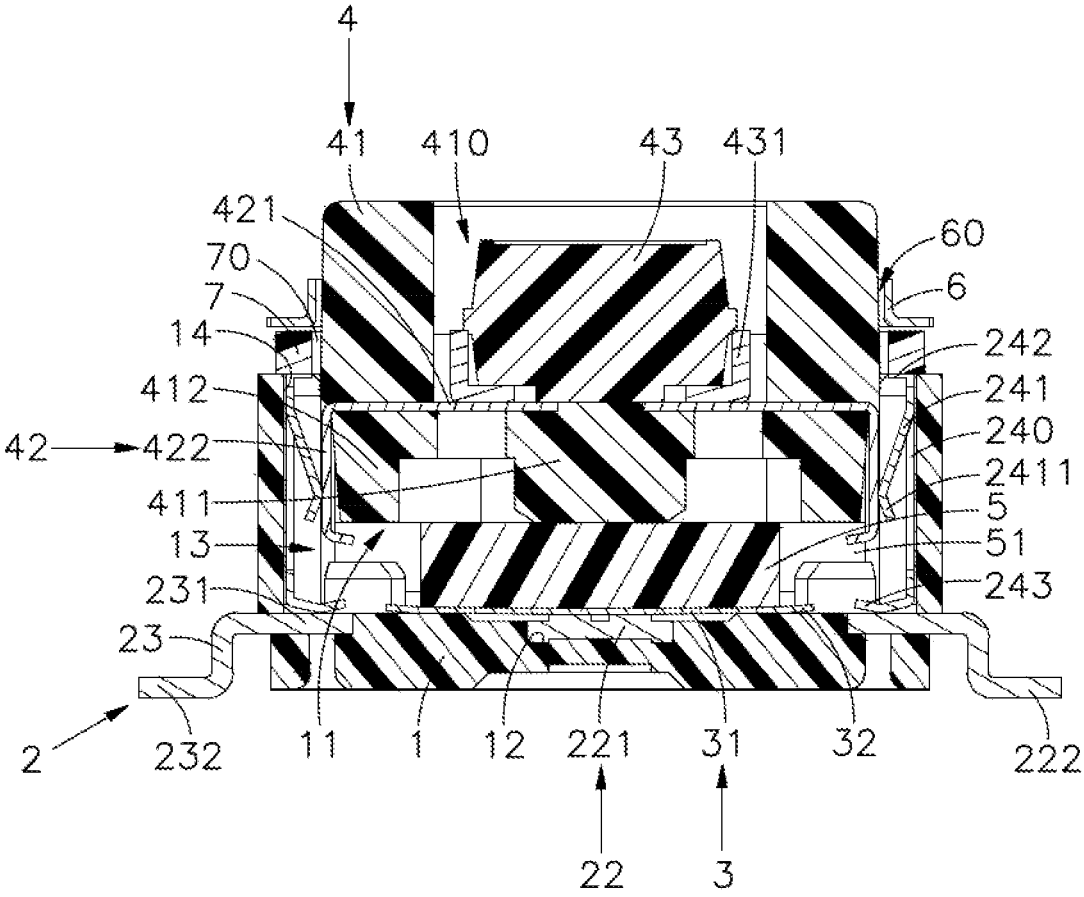
FIG. 5 corresponds to FIG. 4, illustrating the press device pressed.
Figure 6:
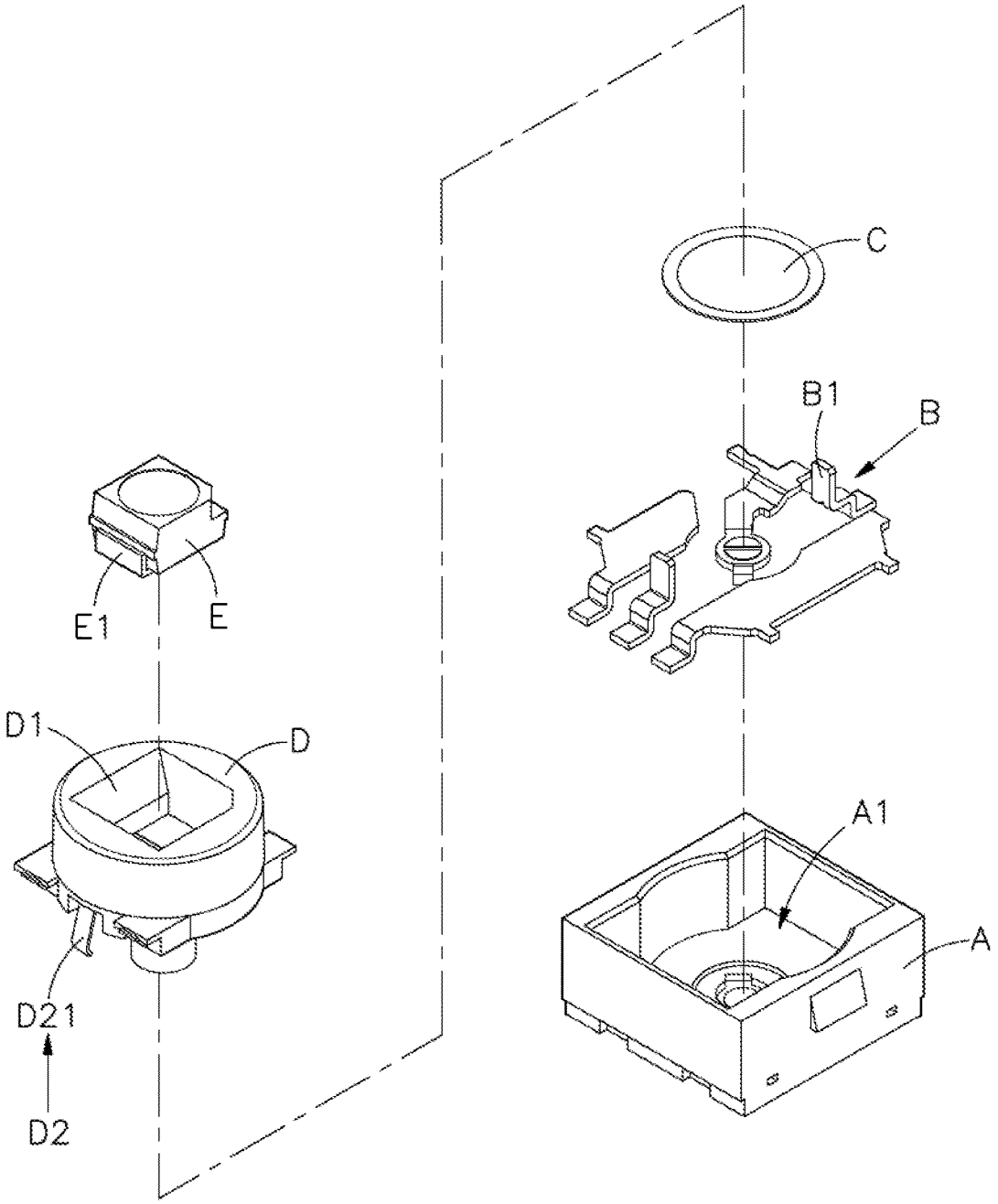
PRIOR ART FIG. 6
FIG. 6 is an exploded view of a strip light switch according to the prior art.
Figure 7:
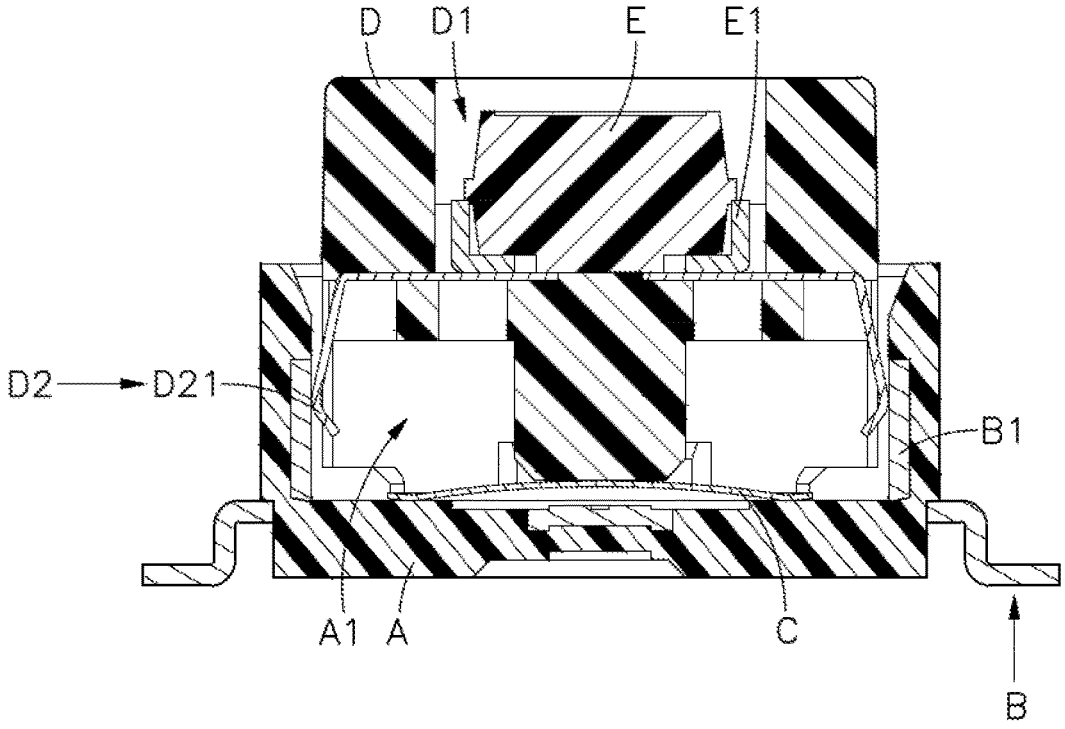
PRIOR ART FIG. 7
FIG. 7 is a sectional side view of the strip light switch according to the prior art.

Referring to FIGS. 4 and 5, in application, give a downward pressure to the cylindrical press block 41 of the press device 4 to force the plunger 411 against the dome-like pressing portion 31 of the conductive shrapnel 3 and to further elastically downwardly deform the dome-like pressing portion 31 into contact with the second contact portion 221 of each second terminal 22, and thus, the at least one first terminal 21 and at least one second terminal 22 of the terminal set 2 are electrically conducted through the conductive shrapnel 3 to provide a signal to the light-emitting component 43 of the press device 4, causing the light-emitting component 43 to emit light upwardly. When the user releases the pressure from the cylindrical press block 41, the dome-like pressing portion 31 of the conductive shrapnel 3 immediately returns to its previous position away from the second contact portion 221 of each second terminal 22. When press the strip light switch again, the light-emitting component 43 is off.

Further, the elastomer 5 can be set between the conductive shrapnel 3 and the press device 4, enabling the position-limiting portions 51 of the elastomer 5 to be positioned in the position-limiting grooves 14 inside the insulative housing 1. When the cylindrical press block 41 of the press device 4 is pressed by an external force, the plunger 411 at the bottom side of the cylindrical press block 41 is forced to give downward pressure to the conductive shrapnel 3 through the elastomer 5, extending the stroke and providing better operating feel The mating connection terminals 24 of the terminal set 2 are detachably mounted in the respective positioning grooves 13 inside the insulative housing 1. If any spring arm 241 of any mating connection terminal 24 is permanently deformed by the conducting plates 42 of the press device 4 or gets broken, the respective mating connection terminal 24 can be removed from the respective positioning groove 13 for a replacement, facilitating maintenance and repair works.

In the present preferred embodiment, the press device 4 is directly mounted in the accommodation chamber 11 of the insulative housing 1 without needing to bend the contact legs 422 of the conducting plates 42, avoiding permanent deformation of the contact legs 422 of the conducting plate 42, ensuring positive conduction with the terminal set 2, facilitating quick installation and increasing product yield.

Further, the mating connection terminals 24 of the terminal set 2 each have the at least one stop lug 242 inwardly extended from the top side thereof and the at least one abutment rod 243 inwardly extended from the opposing bottom side thereof. When the mating connection terminals 24 are respectively positioned in the positioning grooves 13 of the insulative housing 1, the stop lugs 242 of the mating connection terminal 24 are respectively stopped at the respective recessed stop edges 131 to enhance positioning stability, and the abutment rods 243 of the mating connection terminal 24 are respectively disposed in contact the third contact portions 231 of the respective third terminal 23, enhancing signal transmission stability of reliability.

Further, the protruding blocks 412 are located at the bottom side of the cylindrical press block 41 of the press device 4; the contact legs 422 of the conducting plates 42 are respectively supported on the respective protruding blocks 412 outside the cylindrical press block 41. When the cylindrical press block 41 of the press device 4 is pressed after its installation in the accommodation chamber 11 of the insulative housing 1, the contact legs 422 of the conducting plates 42 are stopped at the respective protruding blocks 412, preventing permanent deformation or breaking due to squeezed pressure from the spring arms 241 of the mating connection terminals 24, and thus, the lifespan of the conducting plates 42 can be prolonged.

Further, the mating connection terminals 24 of the terminal set 2 are detachably mounted in the respective positioning grooves 13 inside the insulative housing 1 without needing to use any running slider, facilitating mold creation, saving much mold costs. Since no any running slider is used, the invention avoids generation of burr or fouling, maintains good electrical contact, and improves product yield.

What the invention claimed is:

1. A strip light switch, comprising:

an insulative housing comprising an accommodation chamber, a plurality of terminal grooves located in a bottom side inside said accommodation chamber and a plurality of positioning grooves vertically disposed in said accommodation chamber at two opposite sides;

a terminal set comprising at least one first terminal, at least one second terminal and a plurality of third terminals respectively positioned in said terminal grooves and a plurality of mating connection terminals respectively detachably mounted in said positioning grooves and disposed in conduction with the respective said third terminals, each said mating connection terminal comprising a center opening and a spring arm extended from one side thereof over said center opening and suspending in said accommodation chamber;

a conductive shrapnel accommodated in said accommodation chamber of said insulative housing, said conductive shrapnel comprising a dome-like pressing portion and an abutment portion extended around an outer perimeter of said dome-like pressing portion and electrically disposed in contact with said at least one first terminal; and a press device accommodated in said accommodation chamber of said insulative housing and supported above said conductive shrapnel, said press device comprising a cylindrical press block pressable by a user, a recessed receiving chamber defined in a top side of said cylindrical press block, a plunger located at a bottom side of said cylindrical press block and stopped at a top surface of said dome-like pressing portion of said conductive shrapnel for forcing said dome-like pressing portion of said conductive shrapnel into contact with said at least one first terminal and said at least one second terminal electrically, a plurality of conducting plates mounted in said cylindrical press block, each said conducting plate comprising a contact surface located at one end thereof and suspending in said recessed receiving chamber and a contact leg located at an opposite end thereof and disposed outside said cylindrical press block for contact with said spring arm of one respective said mating connection terminal, and a light-emitting component detachably mounted in said recessed receiving chamber, said light-emitting component comprising a plurality of electrodes respectively and electrically disposed in contact with the said contact surfaces of said conducting plates.

2. The strip light switch as claimed in claim 1, wherein said insulative housing further comprises a plurality of position-limiting grooves disposed in said accommodation chamber at two opposite sides; the strip light switch further comprises an elastomer set between said conductive shrapnel and said press device, said elastomer comprising at least one position-limiting portion respectively positioned in said position-limiting grooves of said insulative housing.

3. The strip light switch as claimed in claim 1, wherein said insulative housing further comprises a male retaining structure comprising at least one retaining block and located at the periphery thereof; the strip light switch further comprises a cover covered on said press device, said cover comprising a center through hole for the passing of said cylindrical press block and a female retaining structure located at two opposite lateral sides thereof, said female retaining structure comprising at least one hole respectively force into engagement with said retaining blocks of said male retaining structure.

4. The strip light switch as claimed in claim 3, further comprising a gasket mounted between said press device and said cover, said gasket comprising a center hole for the passing of said cylindrical press block.

5. The strip light switch as claimed in claim 1, wherein said insulative housing further comprises a recessed stop edge located at an open top end of each said positioning groove; each said mating connection terminal of said terminal set comprises at least one stop lug inwardly extended from a top side thereof and stopped at one respective said recessed stop edge.

6. The strip light switch as claimed in claim 1, wherein at least one said first terminal of said terminal set comprises a flat first contact portion located at one end thereof for contact with said abutment portion of said conductive shrapnel electrically, and a first bonding portion located at an opposite end thereof and extended out of said insulative housing; each said second terminal comprises a circular second contact portion located at one end thereof for contact with said dome-like pressing portion of said conductive shrapnel electrically, and a second bonding portion located at an opposite end thereof and extended out of said insulative housing; each said third terminal comprises a third contact portion located at one end thereof and extending toward said second contact portion for contact with one respective said mating connection terminal electrically, and a third bonding portion located at an opposite end thereof and extended out of said insulative housing.

7. The strip light switch as claimed in claim 6, wherein said third contact portion of each said third terminal is disposed in a bottom end of one respective a positioning groove.

8. The strip light switch as claimed in claim 1, wherein said spring arm of each said mating connection terminal comprises an abutment tip extended from a distal end thereof for stopping at the said contact leg of one respective said conducting plate.

9. The strip light switch as claimed in claim 1, wherein each said mating connection terminal of said terminal set comprises at least one abutment rod inwardly extended from a bottom side thereof for abutment against one respective said third terminal electrically.

10. The strip light switch as claimed in claim 1, wherein said press device further comprises a plurality of protruding blocks located at the bottom side of said cylindrical press block for supporting said contact legs of said conducting plates.

* * * * *